United States Patent [19]

Cutler

[11] Patent Number: 5,002,232

[45] Date of Patent: Mar. 26, 1991

[54] APPARATUS FOR SHREDDING CANS

[75] Inventor: William Cutler, Hartlepool, England

[73] Assignee: AMG Resources Corporation, Pittsburgh, Pa.

[21] Appl. No.: 480,655

[22] Filed: Feb. 15, 1990

Related U.S. Application Data

[63] Continuation of Ser. No. 739,762, May 31, 1985, Pat. No. 4,941,619, which is a continuation of Ser. No. 497,421, May 24, 1983, abandoned.

[30] Foreign Application Priority Data

May 27, 1982 [GB] United Kingdom ..... 8215599

[51] Int. Cl.[5] ..... B02C 13/20

[52] U.S. Cl. ..... 241/187; 241/189 R; 241/285 A

[58] Field of Search ..... 241/22, 55, 73, 74, 241/79.3, 187, 189 R, 24, 189 A, 285 R, 285 A, 285 B

[56] References Cited

U.S. PATENT DOCUMENTS

| | | | |
|---|---|---|---|
| 518,011 | 4/1894 | Stedman | 241/285 A |
| 2,539,775 | 1/1951 | Gordon | 241/285 A |
| 3,348,819 | 10/1969 | McIlvaine | 241/57 X |

*Primary Examiner*—Timothy V. Eley

*Attorney, Agent, or Firm*—Burns, Doane, Swecker & Mathis

[57] ABSTRACT

Apparatus and method of shredding cans to produce a shredded material suitable for detinning comprises a chamber having an apertured peripheral wall. A rotor is mounted in the chamber and is moved in contra rotation to the chamber. Cans to be shredded are introduced into the chamber inwardly of the rotor which is provided with impellers. The impellers serve to partly shred the cans and throw the partly shredded cans to the peripheral wall where a bed of partly shredded cans is established. A shearing action occurs in the bed as further cans are urged against the bed by the impellers and the shredded material passes through the apertured peripheral wall to be removed from the apparatus.

8 Claims, 1 Drawing Sheet

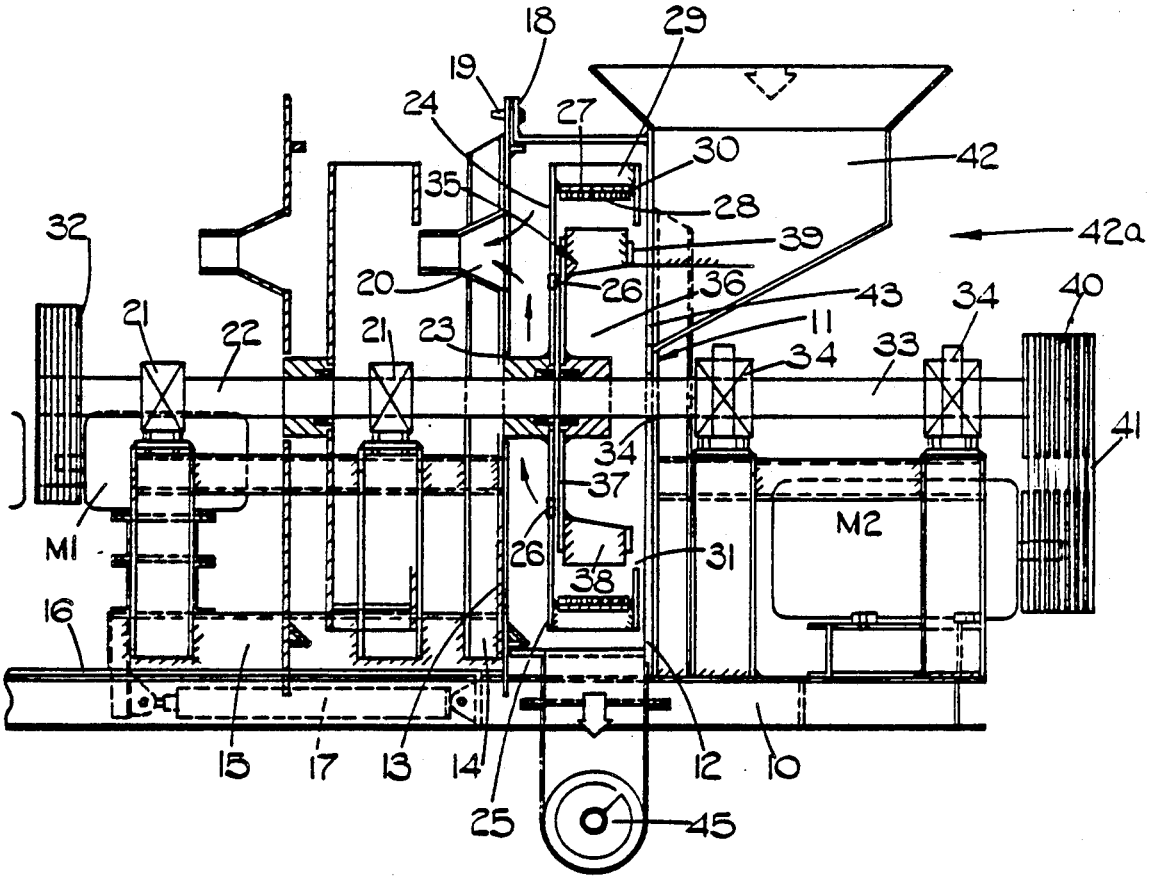
18
29
19
24
27
30
42
35
28
42a
32
39
20
26
36
43
34
40
21
22
21
23
11
34
33
41
34
37
M1
M2
26
31
38
16
15
17
13
14
12
10
25
45

APPARATUS FOR SHREDDING CANS

This application is a continuation of application Ser. No. 739,762, filed May 31, 1985 U.S. Pat. No. 4,941,619, which is a continuation of Ser. No. 497,421, filed May 24, 1983 (now abandoned).

FIELD OF THE INVENTION

This invention relates to an apparatus for and a method of shredding cans e.g. used tinplate cans, canmakers reject cans and used cans which have been flattened or partially shredded by other measns such as knife mills, so as to convert them into a condition where they can be efficiently detinned.

DESCRIPTION OF THE PRIOR ART

It has previously been proposed to shred used tinplate cans using such machines as hammer mills, knife mills and granulators. However, these machines tend to produce pieces of tinplate which are in balled or swaged form, thus making them unsuitpable for detinning since the detinning liquor cannot reach all surfaces of the tinplate pieces. It is also a problem with knife mills and granulators that they are prone to damage by tramp iron inclusions in the feedstock.

GB—20304820 (M. Knezevich) discloses apparatus for the reclamation of waste containing thin-sectioned material by cutting and/or grinding the material to a suitable size and thereafter introducing the material into a chamber having therein a cylindrical liner fitted with screens. The liner defines a peripheral wall of a rotor chamber. The mateirial is repeatedly thrown against ribs on the inner surface of the liner by the rotor so as to be subjected to multiple impacts before passing through the screens as spherized material. Such material, however, does not lend itself to chemical treatment, such as detinning, because only a relatively small surface area is presented for contact with the chemical treatment liquor.

U.S. Pat. No. 3,204,320 (G. R. Eckstein et al) is concerned with the manufacture of ball and shot by a similar process in which non-spherical metal blanks are fed to one end of an elongate cylindrical container which is slowly rotated about its longitudinal axis. A high speed rotor moving contra rotationally relative to the container throws the blanks against the peripheral wall of the container. The container is fitted with scoops which lift the blanks and then release them so that they are subjected to multiple impacts, whereby the blanks are formed to spherical shape and removed from the opposite end of the container. Such a process, like that of GB—2030482, does not result in a product which lends itself readily to chemical treatment such as dentinning.

U.S. Pat. No. 3,283,698 is concerned with a large scale refining apparatus where scrap sheet metal, automobiles etc are first flattened by an overhead crusher and are then subjected to a coarse shredding operation by a rotary shredder which causes the coarsely shredded material to pass through an arcuate coarse screen. The coarsely shredded material is then fed to a nuggetizer to be rolled and folded to form small relatively compact nuggets which also do not lend themselves to efficient chemical treatment for the reason mentioned above.

It is an object of the present invention to obviate or mitigate the above disadvantages.

SUMMARY OF THE INVENTION

According to one aspect of the present invention, there is provided apparatus for shredding cans, said apparatus comprising a body defining a chamber having an apertured peripheral wall, a rotor mounted in the chamber, means for effecting contra rotation of the rotor and the chamber, impellers mounted on the rotor, said impellers being spaced sufficiently inwardly of the peripheral wall to allow a bed of partly shredded cans to be established on the inside of the peripheral wall in use, inlet means connected with the chamber for feeding cans to be shredded, and outlet means for fully shredded cans which have passed through the apertures in the peripheral wall, the arrangement being such that, in use, cans fed to the chamber via the inlet means are thrown outwardly against the apertured peripheral wall by the impellers whereby a bed of partly shredded cans is established so that a shearing action occurs in the bed as further cans are urged against the bed by the impellers.

According to another aspect of the present invention, there is provided a method of shredding cans, comprising the steps of feeding the cans to a chamber having an apertured peripheral wall and a rotor mounted in the chamber, whilst effecting contra rotation of the chamber and the rotor; urging the cans outwardly by means of impellers on the rotors so as to cause a bed of partly shredded cans to be established on the inside of the apertured peripheral wall of the chamber and outwardly of the impellers; reducing the size of the partly shredded cans in the bed by a shearing action so that the fully shredded cans can pass through the apertures in the peripheral wall; and removing the fully shredded cans which have passed through the apertures.

It is found that the shearing action results in a shredded product of relatively open form so that a large surface area is presented for contact by treatment liquor such as detinning liquor. It will be appreciated that the chamber is required to be rotated at a speed such that the centrifugal forces thereby generated permit a bed of material to be established on the peripheral wall of the chamber. Becuase of this, any tramp material (i.e. heavy unshreddable material) which is usually present in minor amounts in the can feedstock, tends to be retained in the bed outwardly of the impellers and therefore reduces wear and damage to the impellers compared with the case where the material is allowed to fall repeatedly into the path of the impellers.

It is preferred for the body defining the chamber and the rotor to be designed so as to be separable to enable cleaning and servicing thereof, and to facilitate removal of tramp material. In a particularly convenient embodiment, the body has an opening therein defining an opening in the side wall of the chamber of a size to allow the rotor to pass therethrough.

Preferably, the opposite side wall of the chamber is provided with one or more apertures therethrough to allow a flow of air through the chamber for dust extraction purposes.

In a particularly convenient embodiment, the body and rotor are contained in a housing having a side wall which is movable relative to the remainder of the housing so that the housing can be opened for cleaning and servicing of the body and rotor.

Preferably, the arrangement is such that the side wall of the housing and the body are mounted on a common support for movement longitudinally of the axis of rotation of the body, and means are provided for effecting such movement.

BRIEF DESCRIPTION OF THE DRAWING

An embodiment of the present invention will now be described, by way of example, with reference to the accompanying drawing which is a sectional view through one embodiment of an apparatus for shredding used tinplate cans according to the present invention.

DETAILED DESCRIPTION

Referring to the drawing, the apparatus comprises a fixed main chassis 10 carrying a housing 11. The housing 11 is formed of a fabricated main housing part 12 fixedly mounted on the chassis 10 and a side plate 13 carried by supports 14 (only one shown) extending upwardly from a carriage 15 disposed relative to the chassis 10 in a manner to be described hereinafter. The main housing part 12 is provided with a peripheral flange 18 having location pins 19 (only one shown) extending therefrom through respective apertures in the side plate 13. The side plate 13 is provided with a tapered conduit 20 for dust extraction pusposes as will be described hereinafter.

Also mounted on the carriage 15 are a pair of pedestal bearings 21 through which a first shaft 22 passes. The first shaft 22 extends into the housing 11 through a central aperture 23 in the side plate 13. At an end portion thereof which is disposed within the housing 11, the shaft 22 has a body 24 keyed securely thereto for rotation with the shaft 22. The body 24, like the housing 11, is of circular cross-section and comprises a radial plate 25 having a ring of small holes 26 intermediate its inner and outer peripheries. The body 24 includes a peripheral wall formed by a short annular sleeve 27 and wear resistant grids 28. The sleeve 27 and grids 28 have a multiplicity of aligned apertures therethrough. The inner surfaces of the grids 28 are smooth. Clamping plates (not shown) are provided for securing the ends of adjacent grids 18 to the sleeve 27. The ends of the grids 28 are slightly recessed to partly receive the clamping plates which have chamfered edges to reduce wear and damage thereto in service. The body 24 further includes a series of radially extending strengthening plates 29 secured to the radial plates 25 and to the outer surface of the sleeve 27. The body 24 further includes an annular plate 30 which is secured to the sleeve 27 and to the plates 29 at the opposite ends thereof to the plate 25. The annular plate 30 is parallel to the plate 25 but perpendicular to the strengthening plates 29. The annular plate 30 has a large diameter central aperture 31 therein.

At the opposite end of the first shaft 22 to the body 24, there is mounted a pulley 32 driven from an electric motor M1.

Disposed on the opposite side of the housing 11 to the first shaft 22 and in alignment therewith, there is a second shaft 33 which is mounted in pedestal bearings 34 fixedly mounted on the main chassis 10. The second shaft 33 extends through a central aperture 34 in the main housing part 12 and has a rotor 35 securely keyed thereto. The rotor 35 is disposed wholely within a chamber 36 defined in the body 24 by the plates 24 and 30 and the sleeve 27. The outer diameter of the rotor 35 is marginally less than the diameter of the aperture 31 in the plate 30. The rotor 35 is made up of a circular disc 37 carrying a series of wear resistant impellers 38 which are spaced apart around the periphery of the disc 37 and project a short distance outwardly of the latter. The impellers 38 are rectangular in cross-section and extend substantially parallel to the axis of rotation of the second shaft 33, the outer edges of the impellers 38 being linear and extending parallel to the longitudinal direction of extend of the grids 28. As can be seen from the drawing, the impellers 38 are spaced some distance inwardly of the grids 28. At the opposite ends thereof to the disc 37, the impellers 38 are secured to a common annular strengthening plate 39.

At the opposite end of the second shaft 33 to the rotor 35, a pulley 40 is provided which is driven via belts 41 by a motor M2.

The housing 11 is provided with a feed duct 42 which communicates with the interior of the housing 11 via an opening 43 and with the chamber 36 in the body 24 via the aperture 31 in the annular plate 30.

In use, motor M1 is energised so as to rotate the body 24 in an anti clockwise direction when viewed in the direction of arrow **42*a*, and the rotor 35 is rotated in a clockwise direction when viewed in the direction of arrow 42*a*, by the motor M2. The motors M1 and M2 are reversible so that the body 24 and rotor 35 can be contra rotated in either direction, as required, in order to allow even wear of the impellers 38 and grids 28. In this embodiment, the body 24 is rotated at a speed of 200 rpm, whilst the rotor 35 is rotated at a speed of about 1500 rpm. Used tinplate cans are then fed into the apparatus through the feed duct 42 and are discharged into the chamber 36 radially inwardly of the impellers 38. The action on introduction of the cans is similar to a hammer mill where the cans are thrown by the impellers 38 against the grids 28 and then bounced back into the path of the impellers 38. This action effects partial shredding of the cans and also effects some balling of the pieces. Some of the larger pieces, however, remain against the grids 28 as a result of centrifugal forces generated by rotation of the body 24, and so build up into an annular bed of partly shredded cans. At this point, the normal impacting action of a hammer mill changes into one of cans being sheared against material in the annular bed of partly shredded cans. It is to be appreciated that a particularly effective shearing action is obtained within the bed because the outer portion of shredded material in the bed tends to move with the body whilst the inner portion of material in the bed tends to move in the opposite direction with the impellers. The shearing action produces a continuous disturbance of the material in the bed so that the smaller pieces of shredded can will pass through and out of the apertures in the grids 28 and sleeve 27. In this embodiment, the apertures in the grids 28 have a size of 20–50 mm, and the radial clearance between the inner surface of the grids 28 and the outer surfaces of the impellers 38 is of the order of 120 mm. As a result of the shearing action, the pieces of shredded can which pass through the apertures are of relatively open configuration so as to permit ready access of detinning liquor to all surfaces thereof. Upon emerging from the apertures in the peripheral surface of the body 24, the pieces of shredded can fall under the action of gravity to the bottom of the housing 11 where they are removed from the machine by a screw conveyor 45** after passing through an air classification system (not shown) which removes dust and shredded paper, cloth plastics and other low density material from the shredded cans.

During the shredding operation, dirt is efficiently separated from the cans and some is removed through the conduit 20, it being appreciated that the high speed rotor 35 with the impellers 38 creates considerable windage which helps to carry the dirt away, the flow of air being through the holes 26. The remainder of the dirt passes in suspension in the windage from the bottom of the housing to be removed by the above-mentioned air classificiation system. To enable in removal of tramp iron and also to enable periodic servicing of the body 24 and rotor 35, the ram 17 is operated so as to extend it which moves the whole assembly of body 24, shaft 22, motor M1 and pedestal bearings 21 on the carriage 15, to the left as viewed in the drawings e.g., on rails 16. The rotor 35 remains within the main housing part 12 but is relatively easily accessible for servicing and/or replacement. Retraction of the ram 17 brings the side plate 13 into engagement with the main housing part 12, the location pins 19 serving to ensure that the two parts 12 and 13 are correctly located relative to one another.

It is found that, with the apparatus described above, good opening of the seams of the cans takes place so as to allow the detinning liquor to penetrate. Additionally, the resultant shredded product has a density high enough to enable a high throughput through the detinning plant.

Typically, the shredded product, after magnetic separation, has the following specification:
Dirt content; 1% max;
Aluminum content; 0.2%;
Density range; 400–600 kg/m$^3$;
Seam opening; greater than 90%.

I claim:

1. Apparatus for shredding metal cans, said apparatus comprising a body defining a chamber having an apertured peripheral wall, a rotor mounted in the chamber, first means for effecting rotation of the rotor and second means for effecting rotation of the chamber in a direction opposite to the rotor, impellers mounted on the rotor, free ends of said impellers being spaced sufficiently inwardly of the peripheral wall to allow a relatively thick bed of partly shredded cans to be established on substantially all of the inside of the peripheral wall during rotation without interfering with the free ends of the impellers, said second means rotating said chamber at a rate sufficient to maintain said bed in contact with the peripheral wall, inlet means connected with the chamber for feeding cans to be shredded, and outlet means for fully shredded cans which have passed through the apertures in the peripheral wall, said first means rotating said impellers at a sufficiently high speed such that cans fed to the chamber via the inlet means are thrown outwardly against the apertured peripheral wall by the rotation of the impellers to partially shred cans and to establish the bed of partly shredded cans, the cooperation between the rotating impellers and the contra-rotating chamber causing a shearing action on the cans in the bed to reduce the size of the partly shredded cans in the bed as further cans are urged against the bed by the impellers.

2. An apparatus as claimed in claim 1, wherein the body defining the chamber and the rotor are designed so as to be separable.

3. An apparatus as claimed in claim 2, wherein the body has an opening therein defining an opening in a side wall of the chamber of a size to allow the rotor to pass therethrough.

4. An apparatus as claimed in claim 3, wherein an opposite side wall of the chamber is provided with at least one aperture therethrough to allow a flow of air through the chamber for dust extraction purposes.

5. An apparatus as claimed in claim 2, wherein the body and rotor are contained in a housing having a side wall which is movable relative to the remainder of the housing so that the housing can be opend for cleaning and servicing of the body and rotor.

6. An apparatus as claimed in claim 5, wherein the side wall of the housing and body are mounted on a common support for movement longitudinally of the axis of rotation of the body, and means are provided for effecting such movement.

7. An apparatus as claimed in claim 1, wherein the thickness of the bed of partly shredded cans is greater than the thickness of one partly shredded metal can.

8. An apparatus as claimed in claim 1, wherein the metal cans are tinplate cans and include seams.

* * * * *